US006531666B2

(12) United States Patent
Huang

(10) Patent No.: US 6,531,666 B2
(45) Date of Patent: Mar. 11, 2003

(54) RECEPTACLE WITH CONTACT POINTS FOR SWITCH

(75) Inventor: Chyong-yen Huang, Taipei (TW)

(73) Assignee: Atom Technology Inc., Taipei (TW)

( * ) Notice: Subject to any disclaimer, the term of this patent is extended or adjusted under 35 U.S.C. 154(b) by 21 days.

(21) Appl. No.: 09/862,331

(22) Filed: May 23, 2001

(65) Prior Publication Data

US 2002/0175059 A1 Nov. 28, 2002

(51) Int. Cl.[7] ..... H01R 13/71

(52) U.S. Cl. ..... 200/51 R; 200/51.02; 200/51.12; 439/224; 439/855

(58) Field of Search ..... 200/51 R, 51.02, 200/51.07, 51.11, 51.12, 284; 439/856, 855, 907, 224

(56) References Cited

U.S. PATENT DOCUMENTS 5,847,345 A * 12/1998 Harrison ..... 439/224 X
6,229,105 B1 * 5/2001 Huang ..... 200/51 R X

FOREIGN PATENT DOCUMENTS

GB 2234121 * 1/1991 ..... 439/224

* cited by examiner

*Primary Examiner*—Renee Luebke
(74) *Attorney, Agent, or Firm*—Rosenberg, Klein & Lee

(57) ABSTRACT

A receptacle will contact points for a switch includes a single-molded base to receive a receptacle with a few conducting metal plates therein. Each conducting metal plate has a portion extending outwardly as a connecting point with a ping, and a contact point that forms part of a control circuit of the switch.

3 Claims, 10 Drawing Sheets

RECEPTACLE WITH CONTACT POINTS FOR SWITCH

BACKGROUND OF THE INVENTION

1. Field of the Invention

This invention relates to a receptacle, and more particularly to a single-molded base to receive a receptacle with a few conducting metal plates formed into a loop mounting therein.

2. Description of the Related Prior Art

Conventional extension cords mostly have multiple receptacles, and each receptacle has a separate control switch, a light, or a protective device. The switch controls the conductivity of the plug hole, the light indicates the plug hole is turned on or off, while the protective device is to protect the receptacle against overload. Prior art receptacles are also molded with a single separated plug hole.

All of the above mentioned prior art devices have a switch control and have a positive and negative connection within the receptacle. However, this design has may restrictions, one of which is that the switches and plug holes require a bigger space. Further, the design is restrained by its mold which is not easy to change.

SUMMARY OF THE INVENTION

It is the primary object of the present invention to provide a receptacle with contact points for a switch.

It is another object of the present invention to provide a receptacle with contact points for a switch, which is compact in size.

DETAILED DESCRIPTION OF THE PREFERRED EMBODIMENTS

Figure 1:
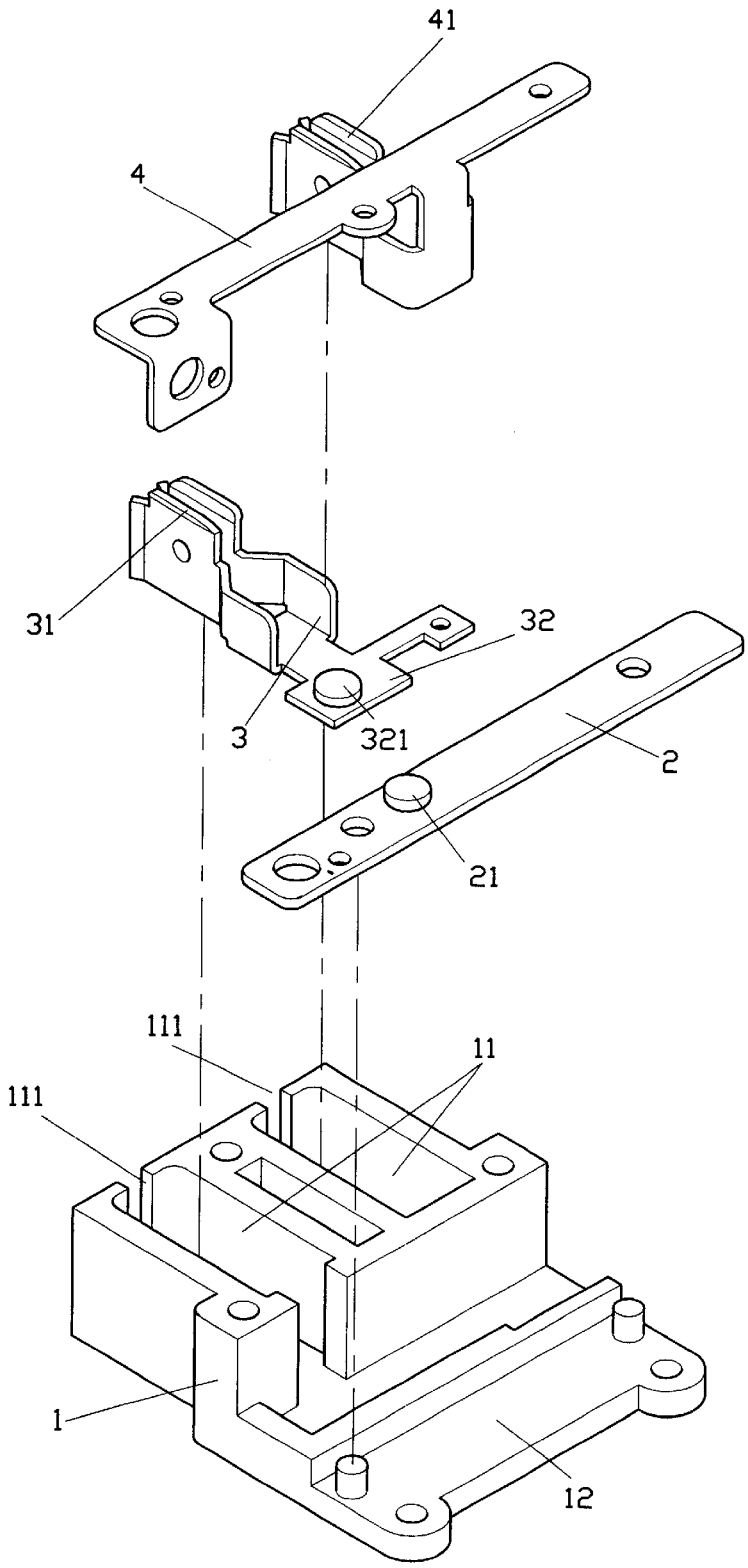
FIG. 1 is an exploded view of the present invention.

The receptacle with contact points for a switch, as shown in FIG. 1, comprises a base 1 for a first conducting plate 2, a second conducting plate 3 and a third conducting plate 4 to be mounted therein.

The base 1 has a trough 11 with two sections therein, the trough 11 has grooves 111 (or open space) at one side corresponding to a slot 31 of the second conducting plate 3 and a slot 41 of the third conducting plate 4. A bridge 12 extends from the other side of the trough 11.

The first conductive plate 2 is a longitudinally extended plate having a contact point 21 thereon, and is seated on the bridge 12.

The second conducting plate 3 comprises a slot 31 which is disposed in one of the sections of the trough 11. The slot 31 is designed to allow insertion from various directions. A contact end 32 extends from slot 31 and has a contact point 321 thereon corresponding to the contact point 21 of the first conducting plate 2.

The third conducting plate 4 has a slot 41 disposed in another section of the trough 11 and is also available for insertion from various directions.

Figure 2:
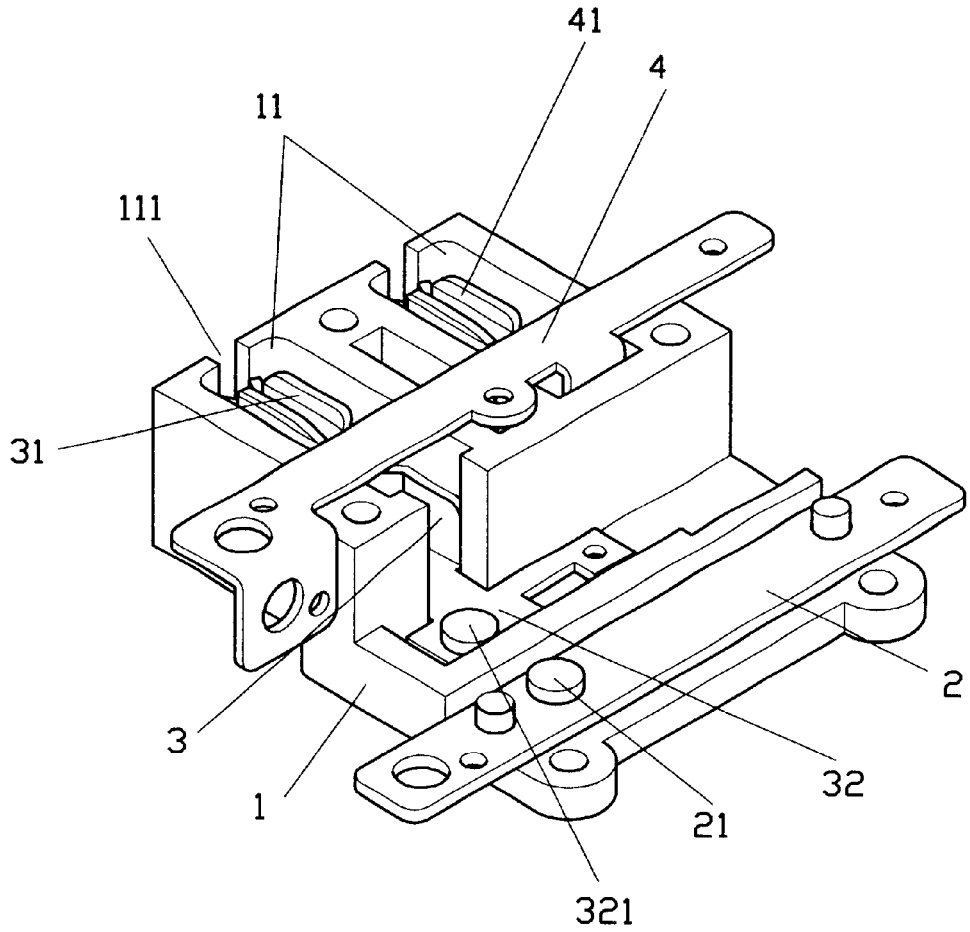
FIG. 2 is a perspective view of a single mold of the present invention.

Upon assembly, the two sections of the trough 11 of the base 1 respectively receive the two slots 31 and 41 therein, as shown in FIG. 2. Wherein, the contact point 321 of the contact end 32 is adjacent to the contact point 21 of the first conducting plate 2, in spaced relationship. This forms a single receptacle that may be used in an extension cord or a wall mount receptacle. Due to the special design of the contact point 21 and the contact point 321, a switching device may be mounted in various arrangements.

Figure 3:
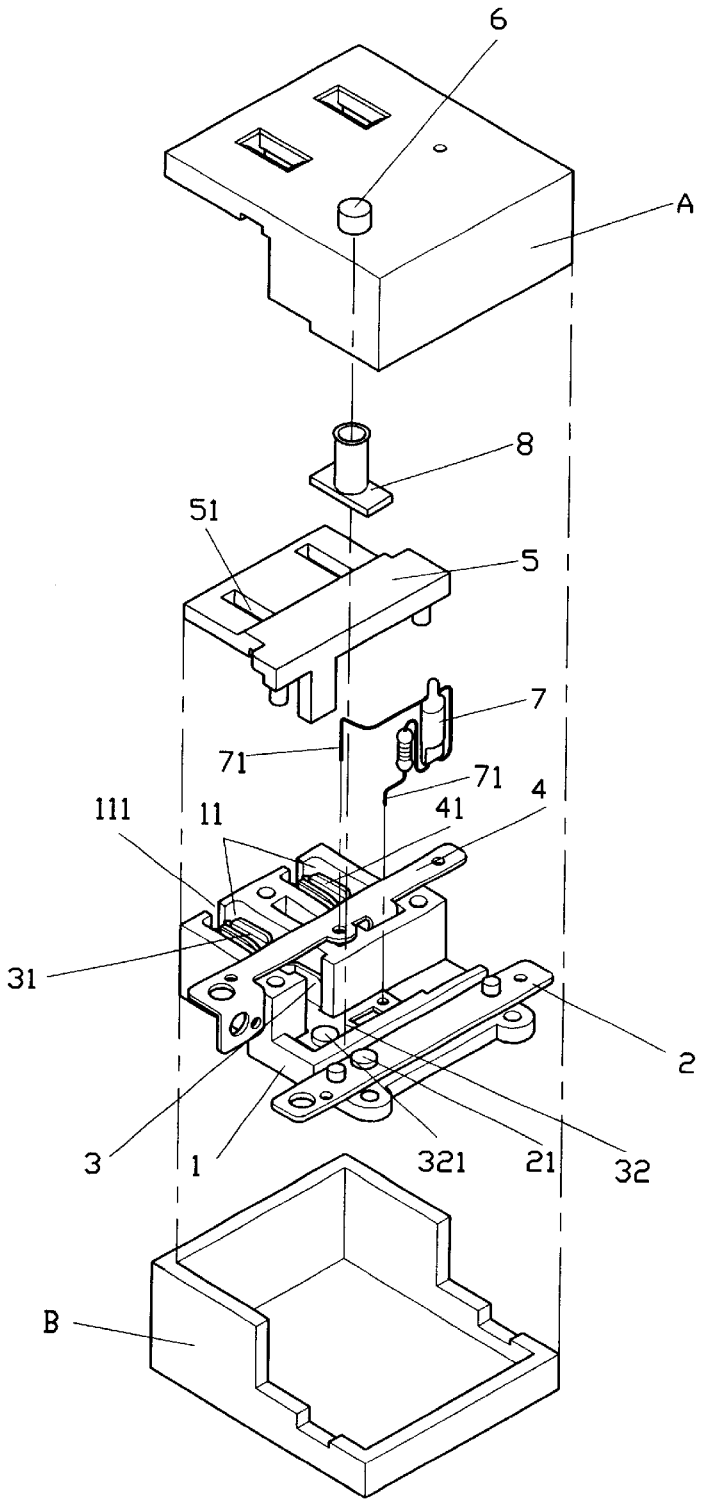
FIG. 3 is an exploded view composed with other devices of the present invention.
Figure 4:
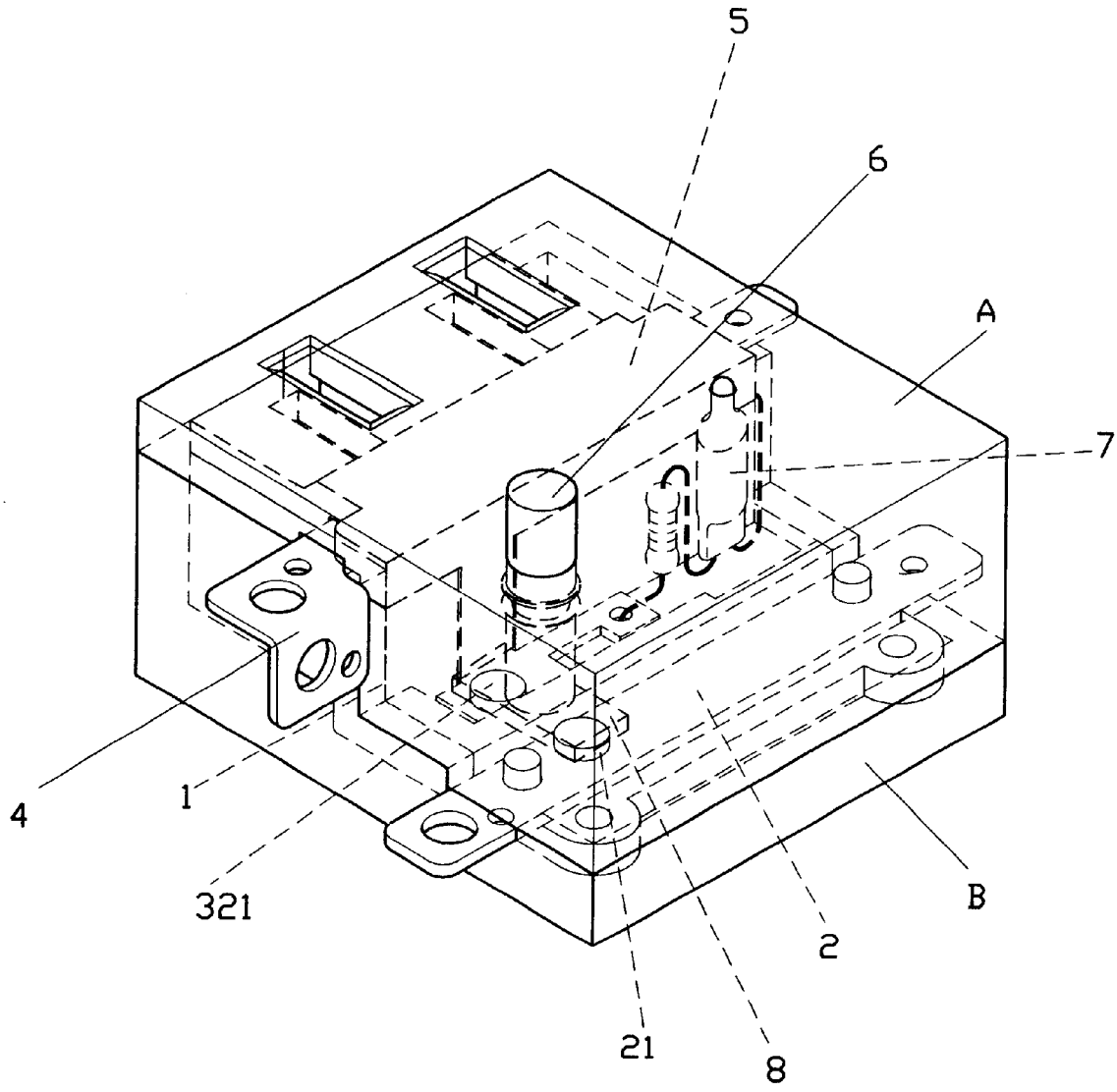
FIG. 4 is a perspective view of a single molded receptacle.

When installed with other devices, the receptacle will require a cover 5, a switch device 6, a light indicator 7 and an upper shell A and a lower shell B, as shown in FIGS. 3 and 4. The cover 5 is placed onto the base 1 with holes 51 (or open space) corresponding to the slots 31 and 41 of the second conducting plate 3 and the third conducting plate 4 in the trough 11. A conducting part 8 is located between the contact point 321 of the contact end 32 extending from the second conducting plate 3 and the contact point 21 of the first conducting plate 2 as a switch to the circuit. This conducting part 8 is linked with the switch device 6. The switch device 6 can be of various designs. The light indicator 7 has its two leads 71 connected with the second conducting plate 3 and third conducting plate 4, respectively. Thus, when the circuit turns on, the light turns on, simultaneously. The light indicator 7 has neither a fixed shape nor a fixed location in the receptacle. The light indicator is shaped in accordance with the design of the upper shell A and the lower shell B, so long as its two leads 71 are able to connect with the second conducting plate 3 and the third conducting plate 4.

Figure 5:
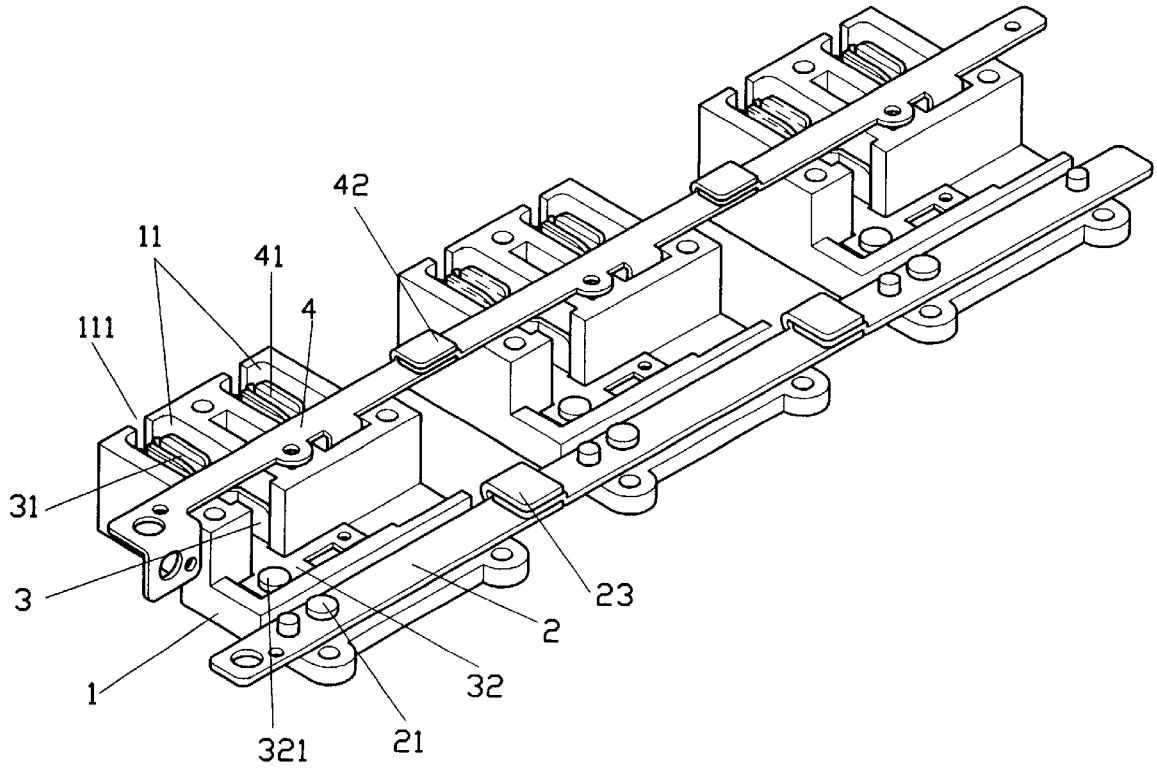
FIG. 5 is a perspective view of a series single molded receptacle.
Figure 6:
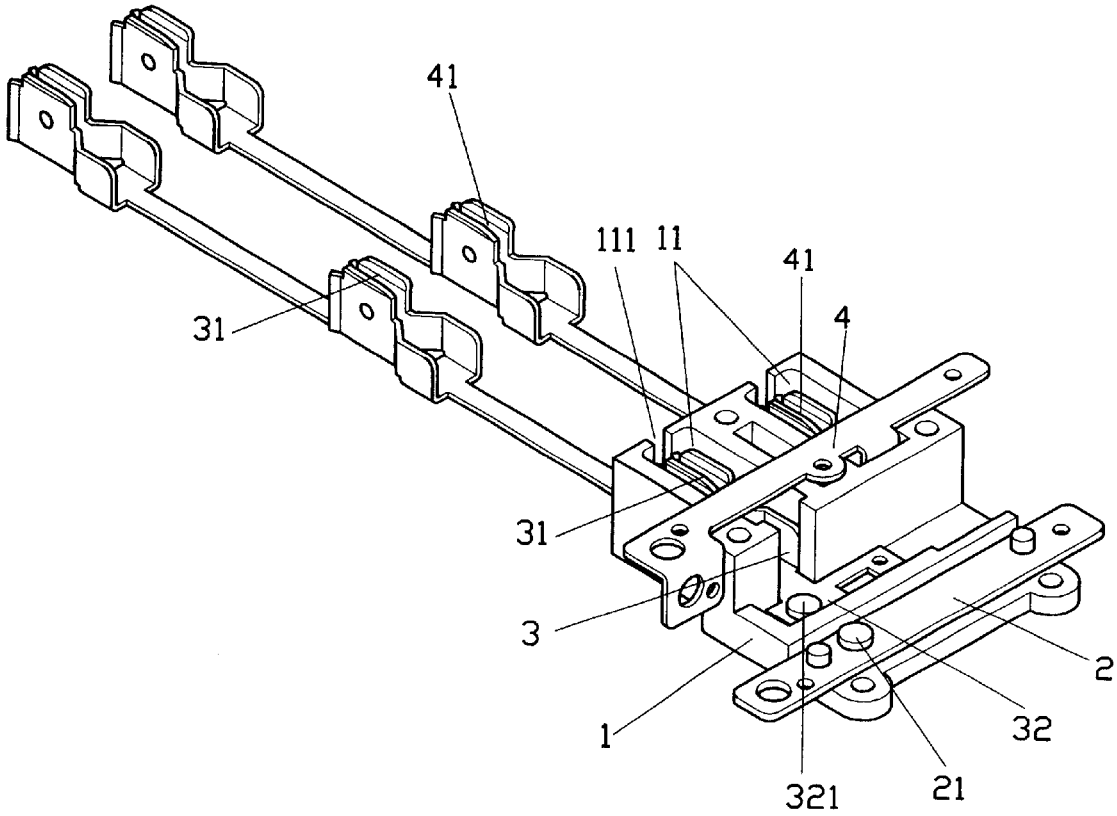
FIG. 6 is another perspective view showing a second embodiment of a series single molded receptacle.

The base 1 receives the first conducting plate 2, the second conducting plate 3, the third conducting plate 4, and other devices to form the switch unit, which may be used as an extension cord, or a wall receptacle. The single mold may be joined with a series or single receptacles. There are two ways to form the single extension cord, and they are:

1. As shown in FIG. 5, at least two identical single receptacles are joined with the first conducting plates 2 and the third conducting plates 4 being connected respectively in series at their clippers 23 and 42. By following the above process, each single receptacle may have similar peripheral devices, such as the switch device 6, and the light indicator 7, to form multiple electric power controlled receptacles.
2. Both the slot 31 of the second conducting plate 3 and the slot 41 of the third conducting plate 4 have respective extending portions which form multiple slots 31 and 41 for multiple plugs to use. Peripherals may be installed at the beginning of the receptacles, so that the receptacles have a single switch device 6 and a single light indicator 7.

Figure 7:
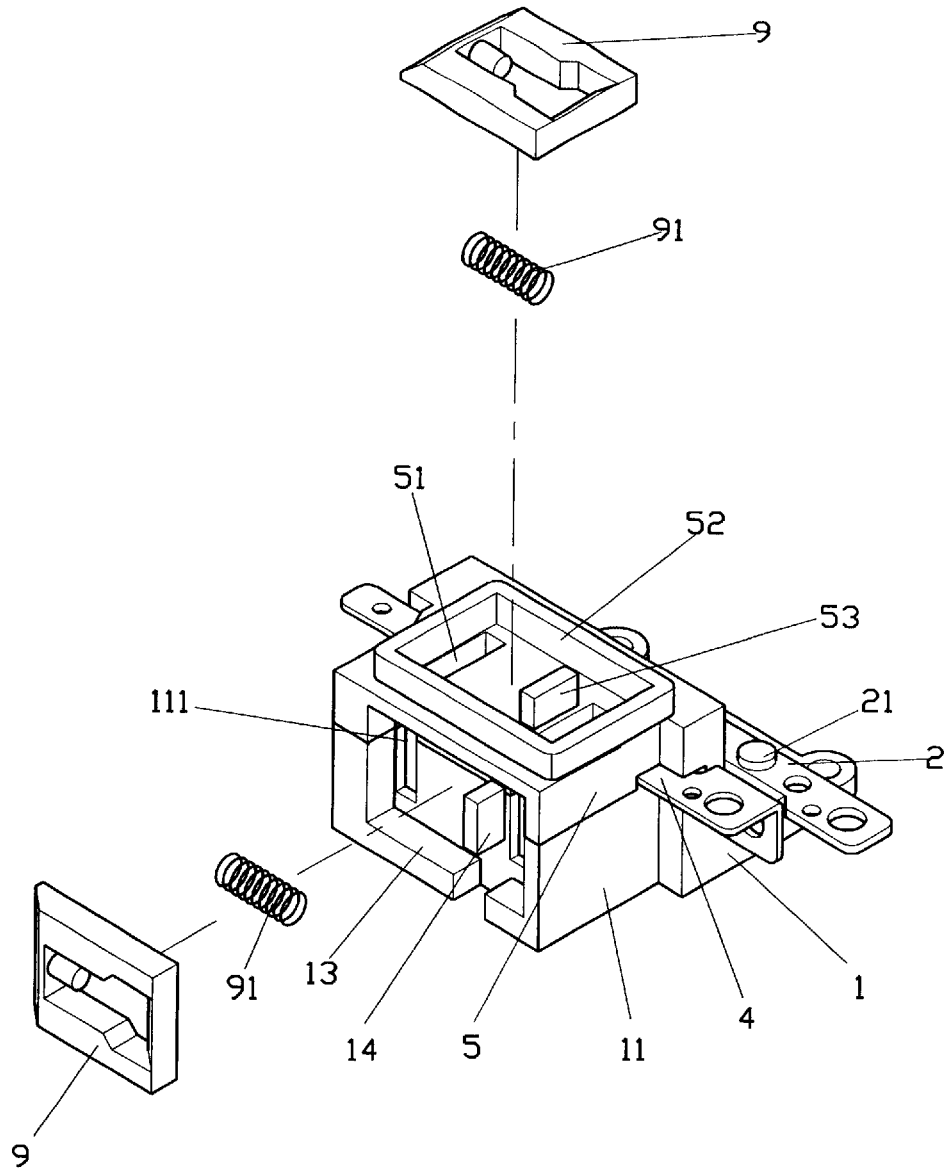
FIG. 7 is a perspective view of a single molded receptacle with a case.

As shown in FIG. 7, the base 1 has a cover 5 with an outwardly extended edge 52. Within the edge 52 and a rib 13 of the base 1 there is formed a receiving section for a cover 9 to mount thereat. Both the edge 52 and the rib 13 have blocks 53 and 14 adapted to engage with a spring 91 threat, respectively.

Figure 8:
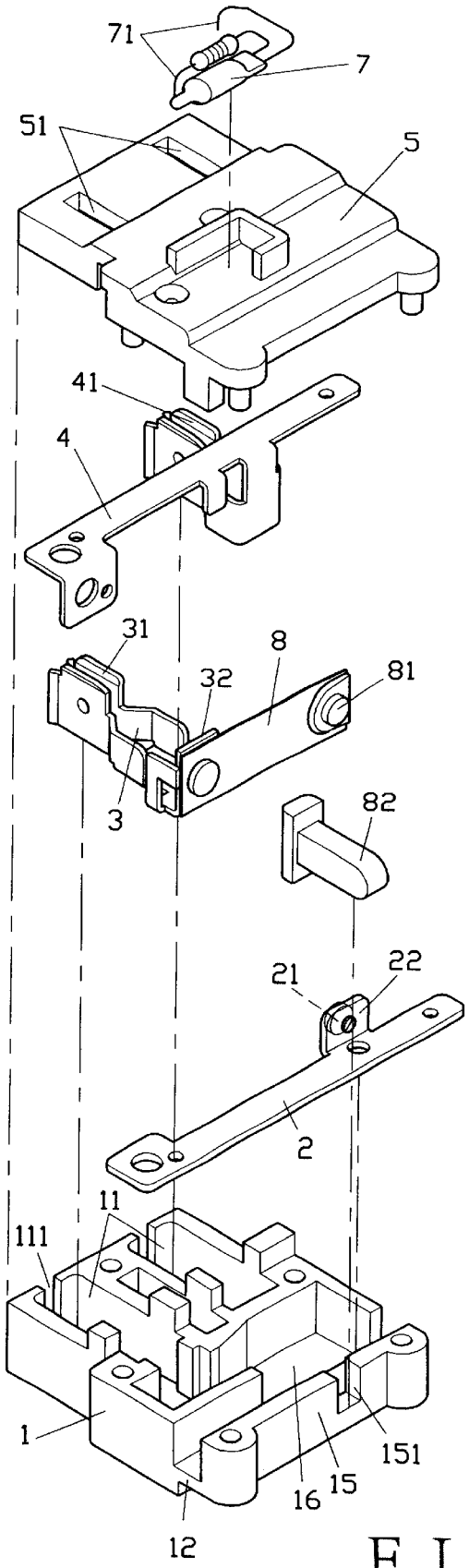
FIG. 8 is an exploded view of a single receptacle of another embodiment including other devices.
Figure 9:
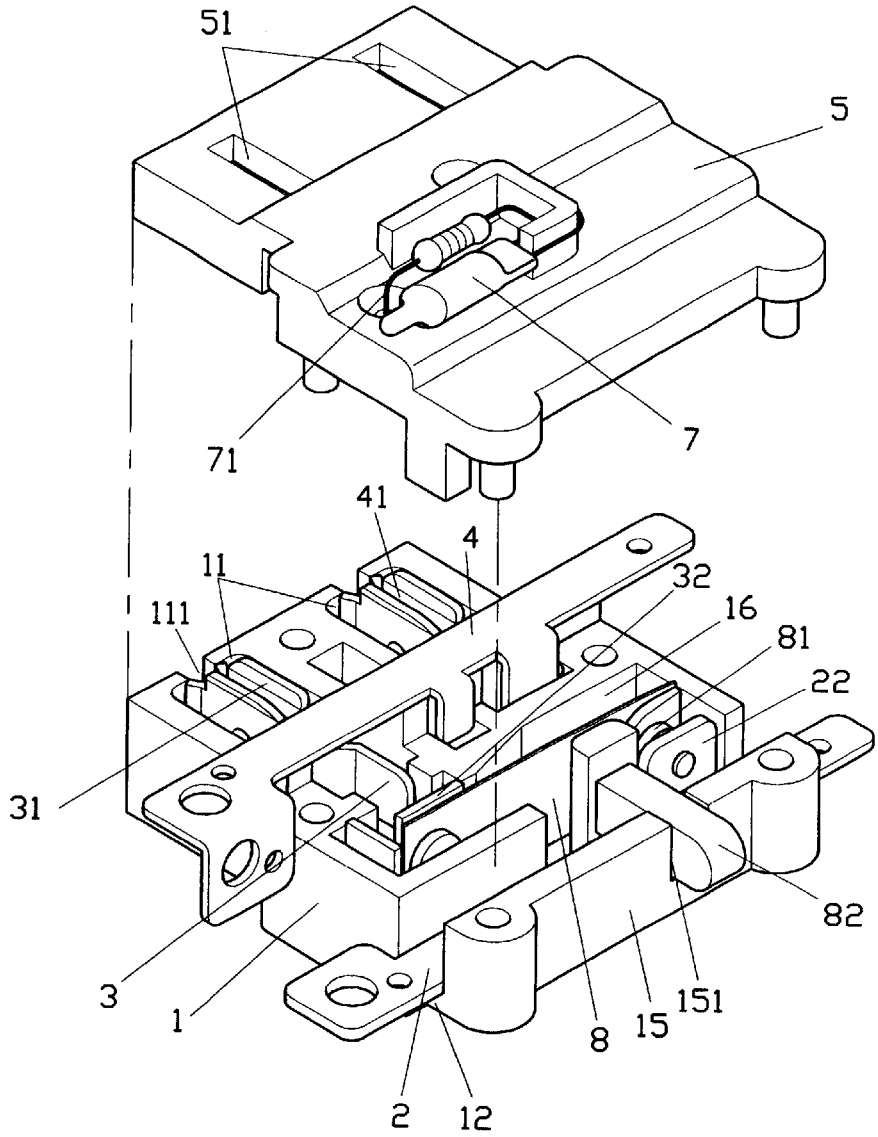
FIG. 9 is a partial assembled perspective view of FIG. 8.
Figure 10:
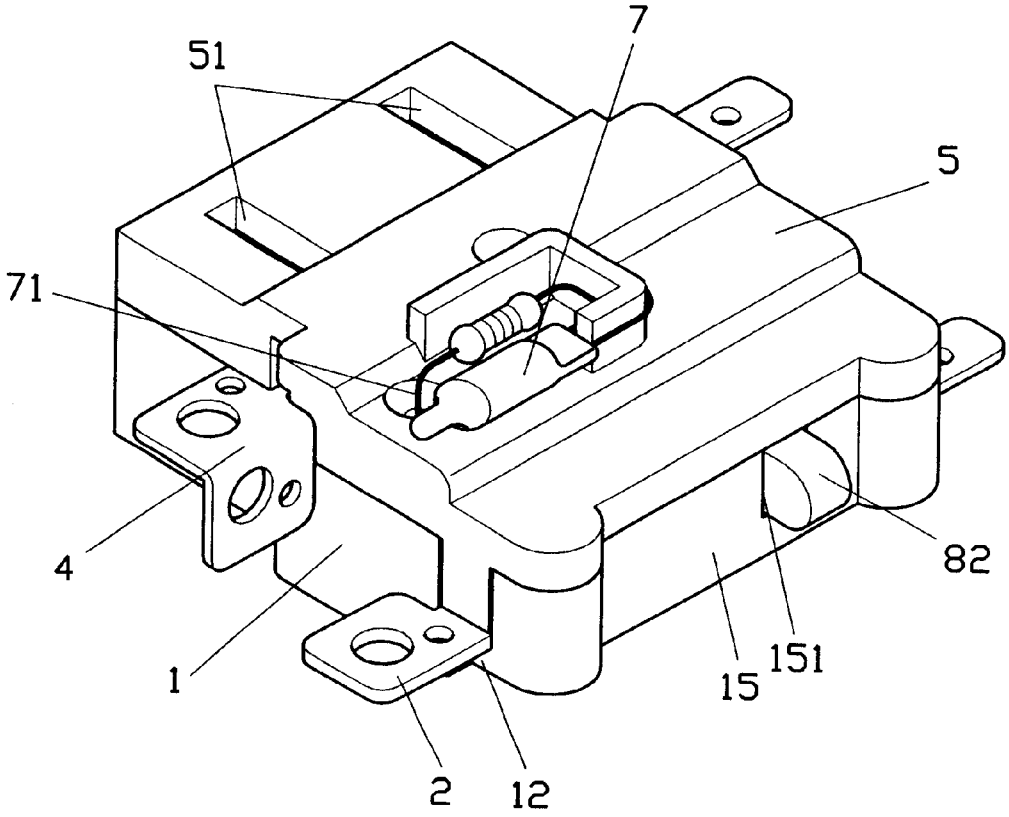
FIG. 10 is a perspective view of the second embodiment.

The shapes of the base 1 and the cover 5 may change at anytime, such as shown in FIG. 8. The first conducting plate 2, the second conducting plate 3 an the third conducting plate 4 are wrapped in the base 1 with the cover 5. The base 1 has a block 15 with a notch 151 there at and a trough 16. The light indicator 7 is placed on the top of the cover 5 with the two leads 71 extending downwardly. The first conducting plate 2 and the second conducting plate 3 may have various shapes, such as where the first conducting plate 2 has an extended contact end 22 with a contact point 21 disposed opposite the contact end 32 of the conducting plate 3. Both of the contact ends 22 and 32 are in vertical position. The contact end 32 of the second conducting plate 3 is connected to one end of a conducting part 8 which has a contact point 81 disposed in contact with the contact point 21 of the contact end 22 of the first conducting plate 2. In addition to connecting with the first conducting plate 2, the conducting part 8 may be linked by a linkage 82 to reciprocal movement for engagement or disengagement between the contact ends 22 and 32. In this manner, as shown in FIG. 9, the conducting part 8 is secured in the trough 16 between the bridge 12 and the trough 11, that separates the first conducting plate 2 and the second conducting plate 3 at respective ends. The linkage 82 stays in the notch 151 of the block 15 above the bridge 12 with its inner end engaging with the conducting part 8, while the outer end extends outwardly. As shown in FIG. 10, the light indicator 7 is secured on the top of the cover 5 with the two leads 71 extending downwardly and in connection with the second conducting plate 3 and the third conducting plate 4, thus the light indicator 7 turns on and off with the movement of the linkage 82.

I claim:

1. A switched receptacle comprising:

a base having a portion with a trough formed therein, said trough being divided into two separate sections, said base having a bridge extending from said portion with said trough;

a first conducting plate having a longitudinally extended contour secured on said bridge, said first conducting plate having a first contact point coupled thereto;

a second conducting plate having at least a portion thereof disposed in a first of a said two sections of said trough, said second conducting plate having a slot formed on a first end thereof for releasable coupling with a first pront of a power plug and a contact end portion formed on a second end of said second conducting plate and extending substantially orthogonal thereto, said contact end portion extending from said first section of said trough and being disposed on said bridge and spaced from said first conducting plate, said contact end portion having as second contact point coupled thereto and disposed in aligned relationship with said first contact point;

a third conducting plate having a first portion thereof extending substantially orthogonal from a second portion of said third conducting plate, said first portion being formed with a slot for releasable coupling with a second prong of a power plug, said first portion of said third conducting plate being disposed in a second of said two sections of said trough, said second portion of said third conducting plate extending over said trough; and a conducting member coupled to a distal end of a switch member and extending between said first and second contact points, said conducting member being displaceable to selectively provide an electrical coupling between said first and second contact points respective to displacement of said switch member.

2. A switched receptacle comprising:

a plurality of bases, each of said bases having a portion with a trough formed therein, said trough being divided into two separate sections, each said base having a bridge extending from said portion with said trough;

a first conducting plate having a longitudinally extended contour secured on said bridge of each of said bases, said first conducting plate having a plurality of first contact points coupled thereto and disposed in longitudinally spaced relationship;

a plurality of second conducting plates, each of said second conducting having at least a portion thereof disposed in a first of said two sections of said trough of a respective one of said bases, each of said second conducting plates having a slot formed on a first end thereof for releasable coupling with a first prong of power plug and a contact end portion formed on a second end of said second conducting plate and extending substantially orthogonal thereto, said contact end portion extending from said first section of said trough of said respective base and being disposed on said bridge of said respective base and spaced from said first conducting plate, said contact end portion of each said second conducting plate having a second contact point coupled thereto and disposed in aligned relationship with a corresponding one of said first contact points;

a third conducting plate having a plurality of first portions extending substantially orthogonal from a second portion of said third conducting plate, each said first portion being formed with a slot releasable coupling with a second prong of a power plug, each said first portion of said third conducting plate being disposed in a second of said two sections of said trough of a respective one of said bases, said second portion of said third conducting plate extending over said trough of each of said plurality of bases; and a plurality of conducting members respectively coupled to a distal end of a plurality of switch members, each of said conducting members extending between a respective pair of said first and second contact points, each of said conducting members being displaceable to selectively provide an electrical coupling between said respective pair of first and second contact points respective to displacement of a corresponding switch member.

3. A switched receptacle comprising:

a plurality of bases, each of said bases having a portion with a trough formed therein, said trough being divided into two separate sections, at least one of said bases having a bridge extending from said portion with said trough;

a first conducting plate having a longitudinally extended contour secured on said bridge of said at least one base, said first conducting plate having a first contact point coupled thereto;

a second conducting plate having a plurality of portions respectively disposed in a first of said two sections of said trough of a respective one of said bases, each of said second conducting plate portions having a slot formed thereon for releasable coupling with a first prong of a power plug, said second conducting plate having a contact end portion formed on an end portion thereof and extending substantially orthogonal to said plurality of portions, said contact end portion extending from said first section of said trough of said at least one base and being disposed on said bridge and spaced from said first conducting plate, said contact end portion of said second conducting plate having a second contact point coupled thereto and disposed in aligned relationship with said first contact point;

a third conducting plate having a plurality portions extending substantially orthogonal from a second portion of said third conducting plate, each said first portion being formed with a slot for releasable coupling with a second prong of a power plug, each said first portion of said third conducting plate being disposed in a second of said two sections of said trough of a respective one of said bases, said second portion of said third conducting plate extending over said trough of said at least one base; and a conducting member coupled to a distant end of a switch member and extending between said first and second contact points, said conducting member being displaceable to selectively provide an electrical coupling between said first and second contact points respective to displacement of said switch member.

* * * * *